United States Patent [19]

Mogi et al.

[11] 4,051,823

[45] Oct. 4, 1977

[54] INTERNAL COMBUSTION ENGINE

[75] Inventors: Minoru Mogi, Tokyo; Shoichi Matsumoto, Mitaka, both of Japan

[73] Assignee: Fuji Jukogyo Kabushiki Kaisha, Tokyo, Japan

[21] Appl. No.: 639,160

[22] Filed: Dec. 9, 1975

[30] Foreign Application Priority Data

Dec. 24, 1974 Japan ..... 49-1202[U]

[51] Int. Cl.[2] ..... F02P 5/04

[52] U.S. Cl. ..... 123/117 A; 123/97 B

[58] Field of Search ..... 123/117 A, 117 R, 97 B

[56] References Cited

U.S. PATENT DOCUMENTS

| | | | |
|---|---|---|---|
| 3,272,191 | 9/1966 | Walker | 123/117 A |
| 3,547,089 | 12/1970 | Pierlot | 123/117 A |
| 3,603,298 | 9/1971 | Toda et al. | 123/117 A |
| 3,650,253 | 3/1972 | Cooksey | 123/117 A |
| 3,677,238 | 7/1972 | Harada et al. | 123/117 A |

*Primary Examiner*—Ronald H. Lazarus
*Assistant Examiner*—Tony M. Argenbright
*Attorney, Agent, or Firm*—Martin A. Farber

[57] ABSTRACT

An internal combustion engine has a throttle opener arrangement whereby a throttle valve is slightly opened during deceleration of the engine in response to intake manifold vacuum and a distributor with a vacuum spark timing control system. The vacuum spark timing control system is exposed to the intake manifold vacuum during deceleration of the engine to retard the spark timing.

2 Claims, 1 Drawing Figure

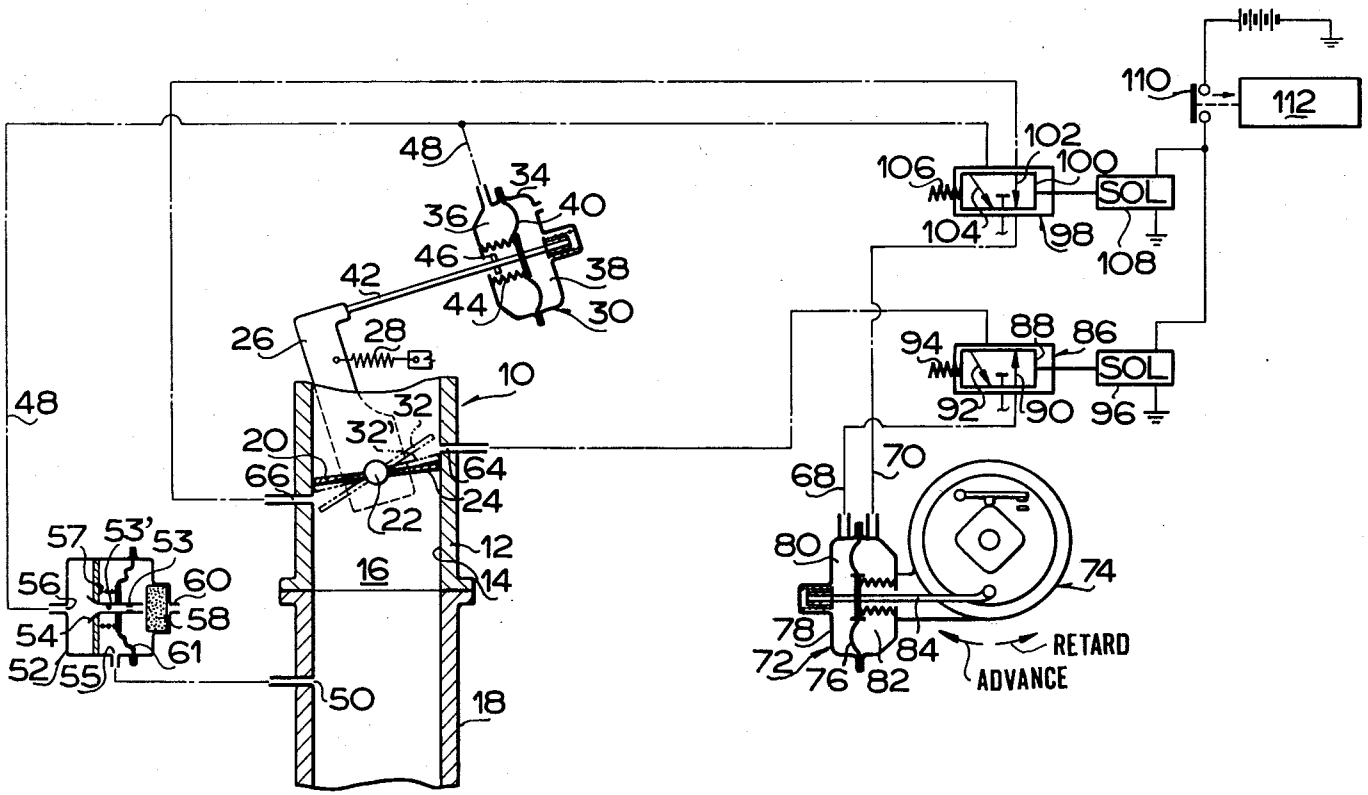
SOL
SOL
RETARD
ADVANCE

INTERNAL COMBUSTION ENGINE

The present invention relates to an internal combustion engine and more particularly to an internal combustion engine in which a throttle valve is slightly opened during deceleration of the engine to admit air-fuel mixture into engine cylinders and in which the spark timing is retarded during engine operation at relatively low engine speeds to lower the combustion temperature so as to reduce the formation of nitrogen oxides, whereas the spark timing is advanced during engine operation at relatively high engine speed so as to improve fuel economy and power output.

In a known internal combustion engine a distributor is equipped with an intake passageway vacuum operated spark timing control system which in response to the engine speed retards the spark timing when the engine speed is lower than a reference engine speed and advances the spark timing when the engine speed is higher than the reference engine speed, in order that the formation of nitrogen oxides be reduced during engine operation at low engine speeds and that fuel economy and power output are improved during engine operation at high engine speeds. In the known engine a throttle opener is operatively connected with a throttle valve so as to slightly open the throttle in response to deceleration engine operation at high speeds, in order to reduce hydrocarbon concentrations in the exhaust gases during deceleration of the engine. The problem with the engine of the above character is that when the engine is decelerating at high engine speeds, the engine will not serve as an engine braking because the throttle valve is slightly opened.

Accordingly, an object of the present invention is to modify an internal combustion engine of the above character so as to solve the above problem.

Another object of the present invention is to provide an internal combustion engine of the above character in which the engine serves for engine braking during deceleration engine operation at high engine speeds.

These and other objects, features and advantages of the present invention will now be described in connection with the accompanying drawing, in which:

A single FIGURE is a schematic view of a part of an internal combustion engine according to the preferred embodiment of the present invention.

Referring to the accompanying drawing, a portion 10 of the downdraft type carburetor is illustrated. More particularly, the carburetor is provided with a main body portion 12 having a cylindrical bore 14 providing the conventional air fuel intake passageway 16. The latter is connected to a conventional intake manifold 18, from which the air and fuel mixture passes to the engine cylinders, not shown, in a known manner.

The flow of air and fuel mixture through the intake passageway 16 is controlled by a conventional throttle valve 20. The latter is mounted on a shaft 22 rotatably mounted in the side walls of the main body 12 in a known manner. A main fuel system is not shown, since it can be any of many known types. Suffice to say that the fuel would be induced into the passageway 16 above the throttle valve 20 in a known manner as a function of rotation of the throttle valve 20 from its idle speed position 24 to a widely opened position.

A lever or link 26 is fixed to or formed integral with the throttle valve shaft 22 for rotation with it, a tension spring 28 biasing lever 26 in a clockwise direction at all times to bias the throttle valve 20 towards its idle speed position 24.

The lever 26 is adapted to be moved counterclockwise, as seen in the FIGURE, by a throttle valve control vacuum servo 30 to rotate the throttle valve 20 counterclockwise to its cracked opened position 32'. The servo 30 includes a housing 34 divided into a vacuum chamber 36 and an atmosphere chamber 38 by a flexible diaphragm 40. A stem type actuator or plunger 42 is secured to one side of the diaphragm 40, and slidably and sealingly projects outwardly through the housing 34.

A compression spring 44 is mounted in the vacuum chamber 36. It normally biases the diaphragm 40 and accordingly the plunger 42 in a direction to cause the lever 26 to close the throttle valve. The force of spring 44 is chosen so that in the presence of vacuum which is higher than a predetermined reference in vacuum chamber 36, the diaphragm 40 can move the plunger 42 in a direction to rotate the throttle valve 40 to the cracked opened position 32'. A stopper 46 is formed on the plunger 42 and limits the excessive movement of the plunger 42. A conduit 48 is connected to the vacuum chamber 36.

The conduit 48 is supplied with vacuum delivered from an intake manifold vacuum port 50 opening directly into the intake manifold 18. It could equally open into the carburetor body portion 12 at a position below the throttle valve 20. The vacuum is admitted to the conduit 48 through a vacuum control valve 52. More specifically, the vacuum control valve 52 is illustrated schematically as provided with a tubular valve member 53 having an air bleeder passage 53' with an orifice. The valve member 53 selectively engageable with a valve seat 54 thereby to selectively provide or interrupt fluid communication between ports 55 and 56. A spring 57 normally urges the valve member 53 toward a position to interrupt fluid communication between the ports 55 and 56, and the conduit 48 is vented through the air bleeder passage 53', an air filter 58 and a vent hole 60. The valve member 53 is secured to a flexible diaphragm 61. The diaphragm 61 is responsive to intake passageway vacuum around the vacuum port 50. During decelerating condition of the engine, when the intake passageway vacuum admitted to the port 55 from the vacuum port 50 exceeds a given level, the diaphragm 61 and accordingly the valve member 53 are moved leftward as viewed in the drawing against the force of the spring 57 so that the port 55 is brought into fluid communication with the port 56.

The main body portion 12 of the carburetor 10 has a port 64 formed at a location to communicate with the atmosphere side of the throttle valve 20 when the throttle valve 20 is closed in idle speed position 24 and the vacuum side of the throttle valve 20 when the throttle valve is slightly opened to the position 32 as shown by dotted line. The carburetor 10 also has a port 66 formed at a location to communicate with the vacuum side of the throttle valve 20 when the throttle valve 20 is in the idle speed position 24 and the atmosphere side of the throttle valve 20 when the throttle valve is slightly opened to the position 32 as shiown by dotted line. A vacuum conduit 68 and a vacuum conduit 70 are connected to a vacuum servo 72 of the double action type in a distributor 74.

The vacuum servo 72 includes a flexible diaphragm 76. The diaphragm 76 is mounted in a housing 78 and divides the housing 78 into an advance chamber 80 to which the vacuum conduit 68 is connected and into a retard chamber 82 to which the vacuum conduit 70 is connected. A plunger 84 is secured at one end to the flexible diaphragm 76 and pivoted at the opposite end to a braker plate of the distributor 74 so as to advance the spark timing when the plunger 84 moves to the left and to retard the spark timing when the plunger moves to the right.

The vacuum to the conduit 68 emanates from the port 64 and the vacuum is admitted to the conduit 68 through a solenoid valve 86 of the on-off type. More specifically, the valve body is provided with a slidable valve 88 having a vent passage 90 and a straight through passage 92. A spring 94 normally positions the valve 86 as shown to vent passage 68 when a solenoid 96 is deenergized. The solenoid 96 when energized moves the valve 86 to connect the port 64 to the conduit 68.

The vacuum to the conduit 70 emanates from the port 66 and the vacuum is admitted to the conduit 70 through a solenoid valve 98 of the on-off type. More specifically, the valve body is provided with a slidable valve 100 having two straight through passages 102 and 104. A spring 106 normally positions the valve 98 as shown to connect the port 66 to the conduit 70 when a solenoid 108 is de-energized. The solenoid 108 when energized moves the valve 98 to connect the conduit 48 to the conduit 70 against the force of the spring 106.

The solenoids 96 and 108 are energized when the engine speed is higher than a predetermined reference engine speed. The solenoids 96 and 108 are connected to normally open switch 110 which is designed to be closed when the engine speed sensed by an engine speed sensor 112 is higher than the predetermined reference engine speed.

The operation of the whole system is as follows. Assume now that the engine is running at engine speeds lower than the predetermined reference engine speed. In this condition, the solenoids 96 and 108 are de-energized, thereby venting the conduit 68 and connecting the port 66 to the conduit 70. When, now, the throttle valve 20 is closed or cracked opened, the vacuum is delivered to the chamber 82 of the vacuum servo 72 in the distributor 74 from the port 66 of the carburetor 10, thereby retarding the spark timing. When, nextly the throttle valve 20 is opened wider beyond the slightly opened position 32 for acceleration the vacuum to which the port 66 is subjected to decreases appreciably and approaches the atmosphere pressure, reducing the retardation of the spark timing.

Assume nextly that the engine is running at engine speeds higher than the predetermined reference engine speed. In this condition, the switch 110 is closed by the action of the speed sensor 112, and the solenoids 96 and 108 are energized to connect the port 64 to the chamber 80 and to connect the conduit 48 to the chamber 82, respectively. The vacuum is imposed to the chamber 80 when the throttle valve is opened wider beyond the position 32 through the port 64, thus advancing the spark timing.

It will now be understood that the spark timing is relatively retarded during low speed engine operation, whereas the spark timing is relatively advanced during high speed engine operation.

In accordance with the teaching of the present invention, the conduit 48 is connectable to the conduit 70 and in turn to the chamber 82 when the engine speed is higher than the predetermined reference engine speed. Assume that the throttle valve 20 is closed to the idle speed position 24 upon release of an accelerator pedal (not shown) for deceleration when the engine is running at engine speeds higher than the predetermined reference engine speed, and that the vacuum to which the port 50 is subjected to is higher or greater enough to actuate the diaphragm 61 of the valve 52. The valve 52 now establishes the fluid communication between the ports 55 and 56 so that the vacuum at the port 50 communicates with the conduit 48. The vacuum servo 30 now opens the throttle valve 20 to the position 32'. The vacuum in the conduit 48 is also applied to the vacuum chamber 82 through the passage 104 and conduit 70 as long as the engine speed is higher than the predetermined reference engine speed, thus retarding the spark timing. It should be understood that the throttle valve 20 is slightly opened to admit fuel mixture into the intake manifold 18 and the spark timing is retarded to reduce the combustion efficiency during deceleration of the engine at engine speeds higher than the predetermined reference engine speed whereby effective engine braking will be obtained.

It will now be appreciated that the engine will serve as an effective brake during deceleration of the engine at high engine speeds due to the reduction of the combustion efficiency.

What is claimed is:

1. In an internal combustion engine, having a fuel mixture intake passageway, a throttle valve rotatably mounted across said passageway and movable from a closed engine idling position to a widely opened position, and defining an atmospheric side on one side thereof, and a vacuum side on an opposite side thereof, a throttle valve control means including therein a first diaphragm means defining a throttle control vacuum chamber on one side of the latter, said first diaphragm means being operatively connected to said throttle valve for rotating said throttle valve to a slightly opened position thereof in response to an intake vacuum pressure in said throttle control vacuum chamber, a first conduit selectively connecting said vacuum chamber of said throttle valve control means to said intake passageway at a point downstream of said throttle valve, vacuum control valve means operable in response to the intake vacuum pressure in said intake passageway for selectively communicating said first conduit with said intake passageway and with the atmosphere, respectively, and a distributor comprising a breaker plate and a vacuum servo means operatively connected to each other, said vacuum servo means including therein a second diaphragm means defining first and second vacuum chambers on opposite sides of the latter, respectively, said second diaphragm means being operatively connected to said braker plate for biasing said braker plate toward a spark timing advance position in response to vacuum pressure in said first vacuum chamber and for biasing said braker plate toward a spark timing retarded position in response to vacuum pressure in said second vacuum chamber, respectively, the improvement comprising:

a first solenoid valve means and a second solenoid valve means for being actuated in dependency on engine speed, respectively, a second conduit connecting said first vacuum chamber of said vacuum servo means to said first solenoid valve means, a third conduit connecting said first solenoid valve means to said intake passageway at a position adjacent said throttle valve such that said third conduit communicates with the atmosphere side of said throttle valve when the throttle valve is closed in idle position and communicates with said intake passageway at the vacuum side of said throttle valve when the throttle valve is slightly opened, respectively, said first solenoid valve means communicating said first vacuum chamber in said vacuum servo means with atmosphere when engine speed is lower than a predetermined reference engine speed, and for communicating said first vacuum chamber with said intake passageway via said third conduit when the engine speed is higher than the predetermined speed, respectively, a fourth conduit connecting said second vacuum chamber of said vacuum servo means to said second solenoid valve means, a fifth conduit connecting said second solenoid valve means to said intake passageway at another position adjacent said throttle valve such that said fifth conduit communicates with the vacuum side of said throttle valve when the throttle valve is closed in idle position and communicates with the atmospheric side of said throttle valve when the throttle valve is slightly opened, respectively, and a sixth conduit connecting said second solenoid valve means to said first conduit, said second solenoid valve means communicating said second vacuum chamber in said vacuum servo means with said fifth conduit when the engine speed is lower than the predetermined speed, and for communicating said second vacuum chamber with said sixth conduit when the engine speed is higher than the predetermined speed, respectively.

2. In the internal combustion engine as set forth in claim 1, wherein said vacuum control valve means communicates said intake vacuum pressure in said intake passageway downstream of said throttle valve with said first conduit when the throttle valve is closed and the intake vacuum pressure higher than a predetermined value.

* * * * *

UNITED STATES PATENT AND TRADEMARK OFFICE

CERTIFICATE OF CORRECTION

PATENT NO. : 4051823
DATED : October 4, 1977
INVENTOR(S) : Minoru Mogi et al

It is certified that error appears in the above-identified patent and that said Letters Patent are hereby corrected as shown below:

The drawing on the title page and page including information and abstract should be substituted by the drawing of the patent.

COLUMN 2: line 20, "40" should be --20--

Signed and Sealed this

*Twenty-fourth* Day of *January 1978*

[SEAL]

*Attest:*

RUTH C. MASON
*Attesting Officer*

LUTRELLE F. PARKER
*Acting Commissioner of Patents and Trademark*